US005537725A

United States Patent [19]

Takahashi

[11] Patent Number: 5,537,725

[45] Date of Patent: Jul. 23, 1996

[54] RELEASABLE CATCH FOR HOLDING TOGETHER TWO COMPLEMENTARY PARTS OF A FLEXIBLE ARTICLE

[75] Inventor: Yoshinobu Takahashi, Toyama, Japan

[73] Assignee: YKK Corporation, Tokyo, Japan

[21] Appl. No.: 285,726

[22] Filed: Aug. 4, 1994

[30] Foreign Application Priority Data

Aug. 30, 1993 [JP] Japan ..... 5-046925 U

[51] Int. Cl.[6] ..... A44B 11/26

[52] U.S. Cl. ..... 24/615

[58] Field of Search ..... 24/614–616, 618, 24/682.1, 687, 688, 689

[56] References Cited

U.S. PATENT DOCUMENTS 879,881 2/1908 Lederer ..... 24/615 X
4,633,549 1/1987 Lovato ..... 24/615

FOREIGN PATENT DOCUMENTS 2049241 3/1971 France .
5-39322 5/1993 Japan .
2261699 5/1993 United Kingdom .
2262961 7/1993 United Kingdom .

*Primary Examiner*—James R. Brittain
*Attorney, Agent, or Firm*—Hill, Steadman & Simpson

[57] ABSTRACT

A releasable catch for holding together they body of a bag and a flap of the bag includes a plug member attached to the flap and having a resiliently deformable locking tongue, and a socket member attached at its one end to the bag body and having a gate-shaped locked portion disposed adjacent the one end of the socket member for slidably receiving and thereafter locking the resiliently deformable locking tongue to couple the plug member and the socket member. The locking tongue is tilted toward a backward side of the plug member at a predetermined angle relative to a plane of an attachment portion. When the locking tongue of the plug member is locked into the socket member, the bent plug member tends to turn the socket member about the fixed one end toward the bag body, so that the other or loose end of the socket member is always held in contact with a front surface of the bag body regardless of the content of the bag. The releasable catch thus constructed is sightly in appearance, can be manipulated reliably with utmost ease, and damages neither itself nor another article upon impingement with the latter.

2 Claims, 3 Drawing Sheets

RELEASABLE CATCH FOR HOLDING TOGETHER TWO COMPLEMENTARY PARTS OF A FLEXIBLE ARTICLE

BACKGROUND OF THE INVENTION

1. Field of the Invention

The present invention relates to a clasp or releasable catch for holding together two complementary parts of a flexible article via interlocking engagement between a plug member and a socket member, and more particularly to such a releasable catch which can be coupled and uncoupled reliably with utmost ease and does not damage itself or another article in the coupled state.

2. Description of the Prior Art

Bags, such as rucksacks, briefcases and the like, of the type having a flap generally have a plug member attached to the flap, and a socket member attached to a body of the bag at an appropriate position where the plug member is to be locked in the socket member. When some stuff is to be put in or taken out from the bag, as a front side of the plug member is depressed, a locking tongue of the plug member is brought into and out of interlocking engagement with a gate-shaped locked portion of the socket member for closing and opening the flap.

The plug member includes an attachment portion attached to the flap and a locking tongue adapted to be locked in and released from the socket member. The locking tongue is provided with a resilient locking portion normally projecting from a front surface of the locking tongue. When the front side of the locking tongue is depressed, the locking portion retracts into the locking tongue. Conversely, when the pressure on the locking tongue is released, the locking portion resiliently projects again from the front surface of the locking tongue.

When the flap is to be caught on the body of the bag, the locking tongue of the plug member attached to the flap is forced into the gate-shaped locked portion of the socket member attached to the bag body. In this instance, the resilient locking portion of the locking tongue is depressed by the gate-shaped locked portion against the resiliency thereof and retracts into the locking tongue. A continued advancing movement of the locking tongue causes the resilient locking portion to move past the gate-shaped locked portion of the socket member whereupon the resilient locking portion springs back into its initial, projecting position and is thereby interlocked with the gate-shaped locked portion. On the other hand, when the flap is to be detached from the bag body, the plug member is pulled out to remove the locking tongue from the gate-shaped locked portion of the socket member while the resilient locking portion of the locking tongue is being manually depressed against the resiliency thereof. To achieve this uncoupling operation, the resilient locking portion must be retracted into the locking tongue while pulling the plug member away from the socket member. However, since most bag bodies are highly flexible, the bag body tends to become flexed or deformed when the socket member is depressed as a result of depression of the resilient locking portion of the plug member. Under such condition, an intended retracting movement of the resilient locking portion cannot take place with the result that a smooth coupling and uncoupling of the plug member and the socket member is almost difficult to achieve.

To facilitate a smooth uncoupling of the releasable catch, Japanese Utility Model Publication No. 57-47331 discloses a releasable catch including a socket member attached to the body of a bag. The socket has a base plate bent at its central portion into a stepped form which is composed of an upper locking portion and a lower attachment portion. The lower attachment portion is attached to the bag body so that the upper locking portion defines jointly with the bag body a space large enough to accommodate the user's finger. When a plug member attached to a flap of the bag is to be detached from the socket member on the bag body, the plug member is pulled while depressing a resilient locking portion of the plug member into a locking tongue of the plug member by gripping the plug member from the front and back sides with a finger received in the space between the upper locking portion of the socket and the bag body. The plug member thus gripped can readily be detached from the socket member. However, when the plug and socket members are in an assembled or coupled condition, the movement of the upper locking portion of the socket member is restrained. Accordingly, if the bag body is swelled or expanded by stuffs received in the bag, the space between the upper locking portion of the socket and the bag body is likely to disappear in which instance insertion of the user's finger behind the socket member is no longer possible.

To eliminate the foregoing defect, the present assignee proposed a bag which is equipped with a releasable catch so constructed as to insure easy coupling and uncoupling of a plug member and a socket member in all circumstances (see Japanese Utility Model Laid-open Publication No. 5-39322). The proposed bag is composed of a body to which is attached a plate-like socket member, and a flap to which is attached an attachment portion of a plug member. The plug member has a locking tongue resiliently deformable when depressed on its front side. The socket has on its front surface a gate-shaped locked portion with which the locking tongue of the plug member is releasably interlocked. The socket member has a lower end portion separated from the bag body and an upper end portion secured to the bag body.

However, in the bag disclosed in Japanese Utility Model Laid-open Publication No. 5-39322, the attachment portion and the lower end portion of the socket member lie substantially in the same plane and hence the socket member has a flat and straight plate-like configuration. Accordingly, when the bag body is swelled or expanded by stuffs received therein, the releasable catch tips up about the fixed upper end of the socket member so that the loose or unsecured lower end of the socket member sharply projects from the front surface of bag body. The thus projecting loose end of the socket member deteriorates the appearance of the bag and may be damaged in itself or damage another article when striking against the latter.

SUMMARY OF THE INVENTION

In view of the foregoing drawbacks of the prior art, it is an object of the present invention to provide a releasable catch which can be coupled and uncoupled reliably with utmost ease, is able to retain a recumbent posture lying flat on the outside surface of a bag even when the bag is swelled or expanded by stuffs received therein, and is free from damage incurred on either itself or another article on impingement with the latter.

A releasable catch according to the present invention comprises: a plug member including an attachment portion adapted to be attached to a first flexible part of an article, and a locking tongue connected to the attachment portion and resiliently deformable about a juncture between itself and the attachment portion when depressed by a force applied from a front side of the plug member; and a socket member including a flat base plate, a gate-shaped locked portion disposed on a front surface of the flat base plate adjacent an upper end thereof for slidably receiving therein the locking tongue to lock the same in the socket member, and an attachment portion disposed at the upper end of the flat base plate and adapted to be attached to a second flexible part of the article. The locking tongue is tilted toward a backward side of the plug member at a predetermined angle relative to a plane of the attachment portion.

According to a preferred embodiment, the predetermined angle is in the range of 20 to 40 degrees, and further preferably 28 to 32 degrees.

The socket member may further include a spacer portion disposed between the flat base plate and the attachment portion to space apart the flat base plate and the attachment portion by a distance. The attachment portion extends from the upper end toward a lower end opposite to the upper end at an angle relative to the flat base plate such that the distance between the flat base plate and the attachment portion decreases progressively in a direction away from the spacer portion.

When the plug member and the socket member are to be uncoupled, the lower end of the socket member is gripped by the user's fingers. Since the lower end of the socket member is loose or unsecured to the second flexible part of the article such as a bag, the user can readily grip the loose lower end from the front and back sides thereof regardless of whether the bag is expanded by stuffs received therein or it becomes flexed due to the emptiness of the bag. Accordingly, when the plug member is to be uncoupled from the socket member to open a flap (first flexible part) of the bag, the socket member is gripped by the user's fingers (the thumb and an index finger, for example) from the front and back sides, with the plug member locked in the socket member. While keeping this gripping condition, a front surface of the locking tongue is depressed by the thumb, whereupon the locking tongue is flexed into a flattened shape against the resiliency thereof. The thus flattened locking tongue can be readily detached from the socket member by simply pulling the plug member away from the socket member. When the plug member and the socket member are to be coupled, the loose lower end of the socket member is gripped by the user's fingers to secure the position of the socket member, and while keeping this gripping condition, the locking tongue of the plug member is inserted into the gate-shaped locked portion of the socket member. Upon insertion, the locking tongue resiliently deforms or flexes within the gate-shaped locked portion, and when it moves past the gate-shaped locked portion, the locking tongue springs back into its original shape and automatically snaps with the gate-shaped locked portion.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 4:
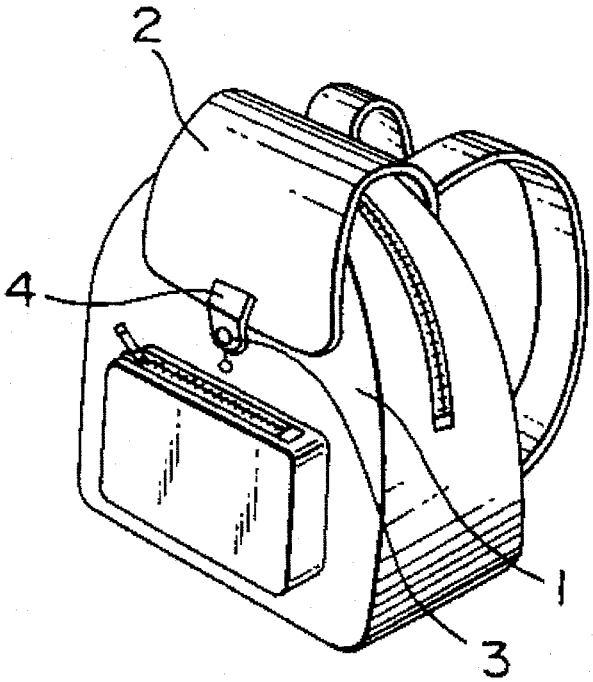
FIG. 4 is a perspective view of a rucksack to which the releasable catch of the present invention is attached.

Referring now to the drawings, wherein like reference characters designate like or corresponding parts throughout the several views, there is shown in FIG. 4 a bag in the form of a rucksack to which is attached a releasable catch according to the present invention.

The rucksack includes a body 1 and a flap 2 attached at one end to the body 1 for covering an opening of the body 1. A socket member 3, which constitutes one part of the releasable catch of the present invention, is attached to a central portion of a front surface of the body 1. A plug member 4, which constitutes the other part of the releasable catch of the present invention, is attached to a central portion of a front edge of the flap 2. The rucksack body 1 and the flap 2 are formed from a flexible material such as a woven fabric, a non-woven fabric, a plastic sheet, a leather, etc. In this context, the flap 2 and the rucksack body 1 respectively form first and second flexible parts of an article that are to be held together by means of the releasable catch of the present invention. The plug member 4 and the socket member 3 have a one-piece structure molded of metal or synthetic resin or assembled with metal or synthetic resin parts.

Figure 1:
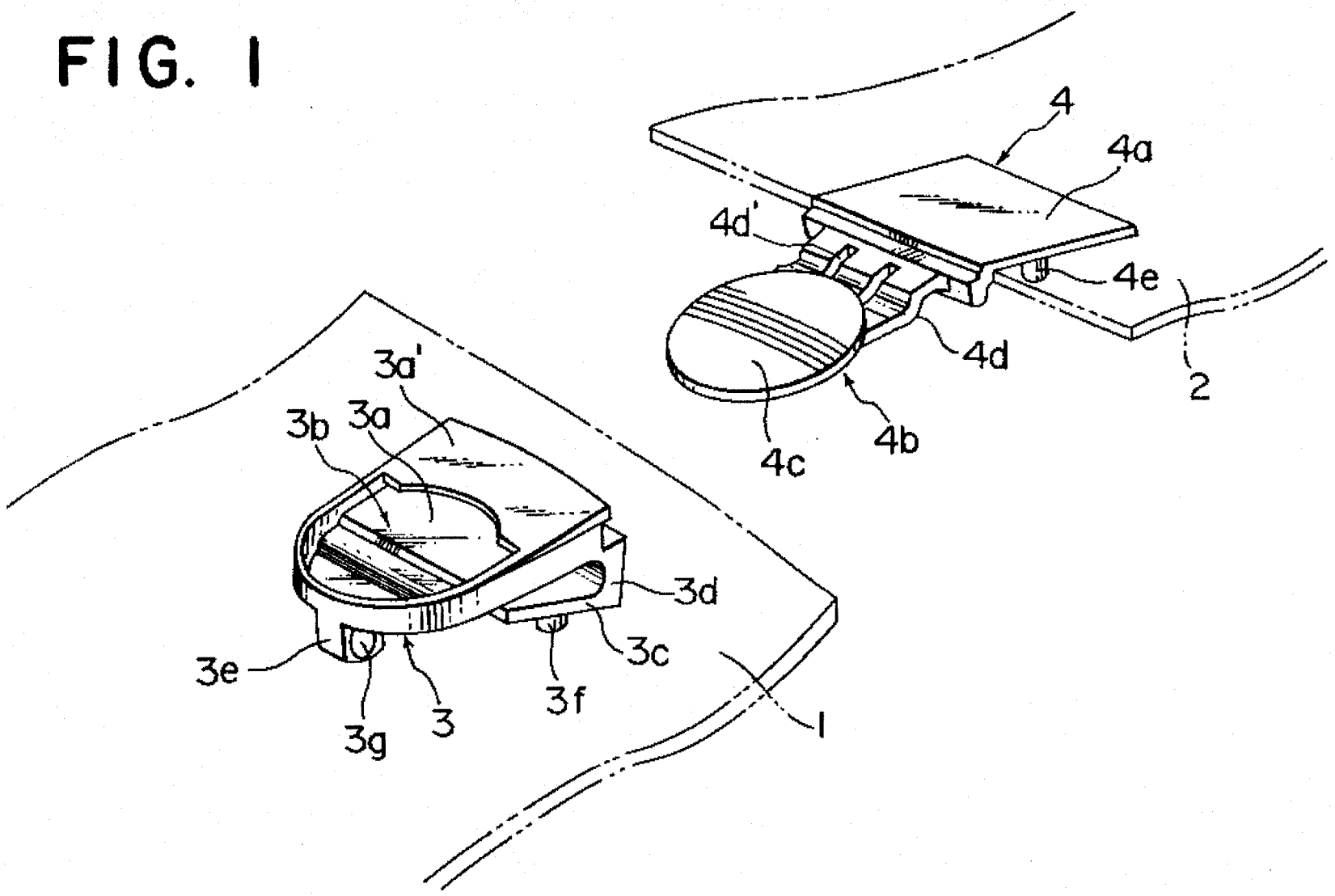
FIG. 1 is a perspective view of a releasable catch according to the present invention shown with a plug member and a socket member in an unassembled or uncoupled condition.
Figure 2:
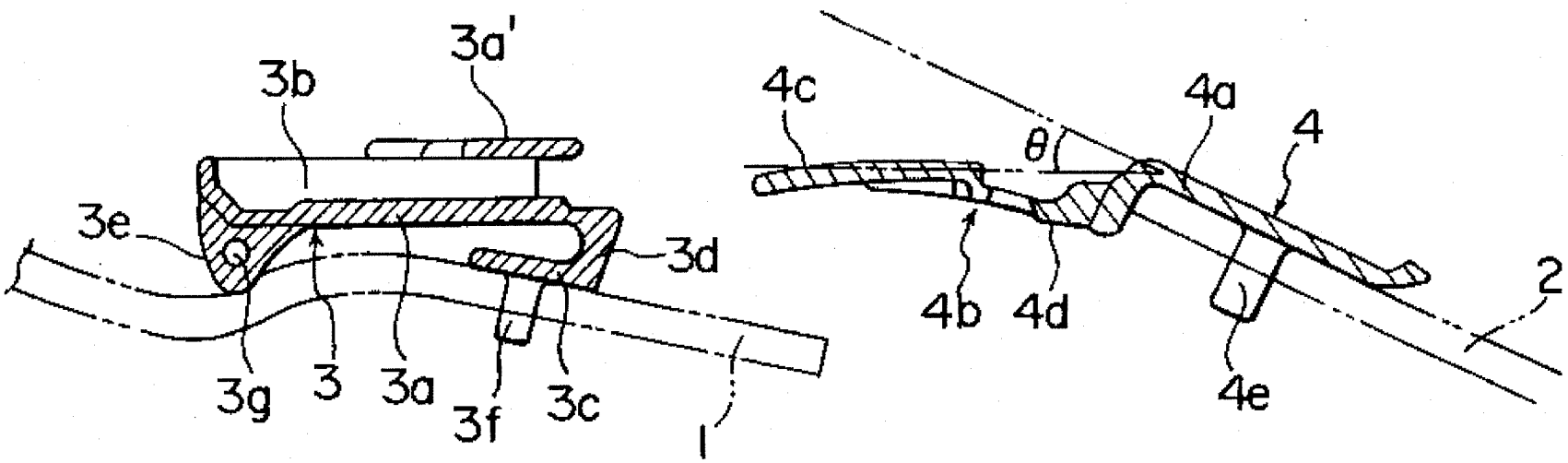
FIG. 2 is a longitudinal cross-sectional view of FIG. 1.
Figure 3:
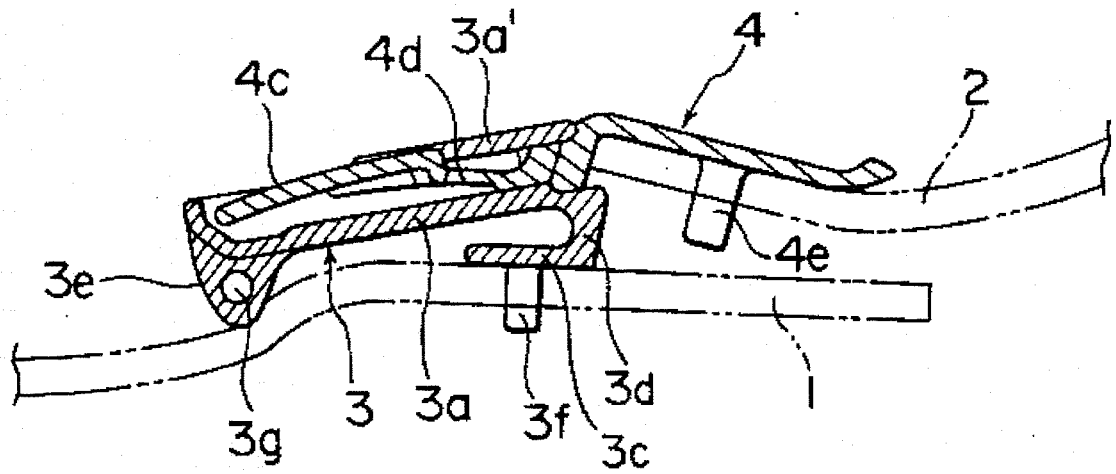
FIG. 3 is a cross-sectional view of the releasable catch shown with the plug and socket members in an assembled or coupled condition.

As shown in FIGS. 1 through 3, the plug member 4 includes a flat rectangular plate-like attachment portion **4*a* secured to the first flexible part 2 (flap), and a locking tongue 4*b* projecting from one edge (front edge in the illustrated embodiment) of the attachment portion 4*a* and slidably receivable in a gate-shaped locked portion 3*a'* (described later) of the socket member 3 to couple the plug member 4 and the socket member 3. The locking tongue 4*b* has a circular plate-like locking portion 4*c* and a resilient root portion 4*d* extending between the locking portion 4*c* and attachment portion 4*a* to interconnect the locking tongue 4*b* and the attachment portion 4*a*. The circular plate-like locking portion 4*c*, after sliding in the gate-shaped locked portion 3*a'* of the socket member 3, is engageable with the gate-shaped locked portion 3*a'* to lock the locking tongue 4*b* in the socket member 3. The resilient root portion 4*d* has two parallel spaced slots 4*d'* extending in a direction parallel to a longitudinal axis of the plug member 4. By virtue of the thus slotted root portion 4*d*, the locking tongue 4*b* is able to resiliently deform or flex about the resilient root portion 4*d* when the locking portion 4*c* is depressed. The plug member 4 further has a plurality of attachment posts or legs 4*e* (only one being shown) projecting from the underside of the attachment portion 4*a* for attaching the plug member 4 to the first flexible part 2** (flap) in a manner described later.

So far as the above-described basic structure is concerned, the plug member 4 of the present invention is substantially the same as that of the conventional plug member shown in Japanese Utility Model Laid-open Publication No. 5-39322 previously mentioned. However, differing from the conventional one, the plug member 4 is bent about the resilient root portion **4*d* into a widely spread or flattened V shape. More specifically, as best shown in FIG. 2, the locking tongue 4*b* of the plug member 4 is tilted toward the backward side of the plug member 4 at a predetermined angle θ relative to the general plane of the plate-like attachment portion 4*a***. The predetermined angle θ of bend is in the range of 20 to 40 degrees, and preferably 28 to 32 degrees. The angle θ, if greater than 40 degrees, would deteriorate the appearance of the bag, hinder smooth coupling and uncoupling operation of the releasable catch, and damage itself or another article due to a relatively sharp ridge formed at the corner of the bent plug member 4. Conversely, the angle θ, if smaller than 20 degrees, would fail to produce a sufficient force tending to turn the socket member about its one end in a direction to keep the releasable catch in a recumbent position, in a manner described later.

As understood from FIG. 1, the socket member 3 has a generally half elliptical shape in the plan view and is attached to the second flexible part 1 (rucksack body) with its rounded end facing downwards of the rucksack shown in FIG. 3. The socket member 3 includes a substantially flat base plate 3*a*, and a gate-shaped locked portion 3*a'* disposed on a front surface of the flat base plate 3*a* adjacent an upper end thereof. Opposite sidewalls of the gate-shaped locked portion 3*a'* are extended toward the rounded lower end of the flat base plate 3*a* along the peripheral edge thereof and mutually joined together so as to define, in the socket member 3, a substantially circular locking recess 3*b* behind the gate-shaped locked portion 3*a'*. The circular locking recess 3*b* is snugly receptive of the circular plate-like locking portion 4*c* of the plug member 4 in a manner described later. The socket member 3 further has a plate-like attachment portion 3*c* connected via a spacer portion 3*d* to the underside of the flat base plate 3*a* at the upper end of the flat base plate 3*a* and extending from the upper end toward the lower end of the flat base plate 3*a* by a certain extent in parallel to the flat base plate 3*a* or in such a manner that the distance between the flat base plate 3*a* and the attachment portion 3*c* decreases progressively in a direction away from the spacer portion 3*d*. A plurality of attachment posts or legs 3*f* (only one being shown) project from the undersurface of the attachment portion 3*c* to secure the attachment portion 3*c* to the second flexible part 1 (rucksack body). The socket member 3 also has a projection 3*e* on the underside of the flat base plate 3*a*, the projection 3*e* being located at the lower end of the flat base plate 3*a*. The projection 3*e* has a height substantially equal to a level of the plate-like attachment portion 3*c* and also has a transverse through-hole 3*g* used for the attachment of an ornament or accessory.

The basic structure of the socket member 3 described above is substantially the same as that of the conventional socket member disclosed in the above-mentioned Japanese Utility Model Laid-open Publication No. 5-39322. The socket member 3 of the present invention differs from the conventional one in that the distance between the flat base plate 3*a* and the attachment portion 3*c* decreases progressively in a direction away from the spacer portion 3*d*, i.e., in a direction from the upper end toward the lower end of the flat base plate 3*a*. To this end, the attachment portion 3*c* is bent or tilted up toward flat base plate 3*a* at an appropriate angle.

The releasable catch of the foregoing construction is attached to the rucksack in a manner described below. The plug member 4 is placed on a central portion of the front edge of the flap 2 with the locking tongue 4*b* projecting outwardly from the front edge. In this instance, the attachment legs 4*e* penetrate the material of the flap 2. Then, rivets (not shown) are driven into the attachment legs 4*e*, with washers (not shown) disposed between the underside of the flap 2 and heads of the rivets, whereby the attachment portion 4*a* of the plug member A is secured to the flap 2 (first flexible part). Similarly, the socket member 3 is placed on a central portion on the front surface of the rucksack body 1, with the gate-shaped locked portion 3*a'* facing toward an opening of the rucksack body 1, and with the attachment legs 3*f* penetrating the material of the rucksack body 1. Then, the attachment portion 3*c* of the socket member 3 is secured to the rucksack body 1 (second flexible part) by means of rivets (not shown) driven into the attachment legs 3*f* with washers (not shown) disposed between the underside of the rucksack body 1 and heads of the rivets.

According to the releasable catch of the present invention, mainly due to the plug member 4 bent into a widely spread V shape, and partly due to the attachment portion 3*c* of the socket member 3 bent upwardly toward the flat base plate 3*a* so as to progressively reduce the distance between the flat base plate 3*a* and the attachment portion 3*c* in a direction away from the spacer portion 3*d*, the releasable catch in the assembled condition is able to retain its recumbent position (FIG. 3) in despite of the presence of the unsecured or loose lower end of the socket member 3, regardless of whether the rucksack body 1 is swelled or expanded by stuffs received therein, or the rucksack body 1 becomes flexed due to the emptiness of the rucksack.

More specifically, when the releasable catch is in the assembled condition (locking position) shown in FIG. 3, the bent plug member 4 tends to turn the socket member 3 in the counterclockwise direction in FIG. 3 about the secured attachment portion 3*c*. This tendency is enhanced by the L-shaped configuration in cross section of a combination of the attachment portion 3*c* and the spacer portion 3*d* of the socket member 3. Accordingly, the loose end of the socket member 3, and more particularly the projection 3*e* on the underside of the loose end is always held in contact with the front surface of the rucksack body 1 regardless of the contents of the rucksack. This means that the releasable catch always holds its recumbent position lying flat on the front surface of the bag and is completely free from accidental tipping and the resultant sharp rising of the loose end of the socket member from the front surface of the rucksack body 1. Thus, the releasable catch is sightly in appearance, can be manipulated easily and reliably, and damages neither itself nor another article seven when it strikes against another article.

When the plug member 4 is to be uncoupled from the socket member 3 to open the flap 2, the socket member 3 is gripped by the user's fingers from the front and back sides with the plug member 4 locked in the socket member 3, and while keeping this gripping condition, the circular plate-like locking portion 4*c* of the plug member 4 is depressed by one of the user's fingers into the socket member 3 against the resiliency of the locking tongue 4*b*. Upon depression of the circular plate-like locking portion 4*c*, the locking tongue 4*b* resiliently deforms or flexes toward the flat base plate 3*a* of the socket member 3 and thereby releases the circular plate-like locking portion 4*c* from locking engagement with the gate-shaped locked portion 3*a'* of the socket member 3. The plug member 4 thus unlocked can readily be removed from the socket member 3 by pulling the plug member 4 or the flap 2 away from the socket member 3.

When the plug member 4 and the socket member 3 are to be coupled to close the flap 2, the loose lower end of the socket member 3 is gripped by the user's fingers from the front and back sides to fix the position of the socket member 3. While keeping this gripping condition, the locking tongue 4*b* of the plug member 4 is forced into the gate-shaped locked portion 3*a'* of the socket member 3. Upon insertion, the locking tongue 4*b* resiliently deforms or flexes toward the flat base portion 3*a* within the gate-shaped locked portion 3*a'*. As the advancing movement of the plug member 4 continues, the circular plate-like locking portion 4*c* moves past the gate-shaped locked portion 3*a'*, whereupon the locking tongue 4*b* springs back upwardly to restore its original shape. When the locking tongue 4*b* restores its original shape, the circular plate-like locking portion 4*c* snaps with the gate-shaped locked portion 3*a'*, with the circular plate-like locking portion 4*c* snugly received in the circular locking recess 3*b* behind the gate-shaped locked portion 3*a'*.

As is apparent from the foregoing description, the plug member 4 of the releasable catch according to the present invention is bent into the widely spread or flattened V shape about the juncture between the resilient locking tongue 4*b* and the attachment portion 4*a* secured to the first flexible part 2 of the article. On the other hand, the socket member 3 of the releasable catch has the loose or unsecured lower end opposite the upper end at which the gate-shaped locked portion 3*a'* is located, and at which the socket member 3 is secured to the second flexible part 1 of the article. The plug member 4 and the socket member 3 can be coupled and uncoupled easily and reliably regardless of the condition of the two flexible parts of the article. While the releasable catch is in the assembled or coupled condition, the loose lower end of the socket member is always in contact with the second flexible part of the article. Thus, the loose end of the socket member 3 is free from damage and does not damage another article when it strikes against the latter. Such an advantageous effect can be enhanced when the bent plug member 4 is combined with an upwardly bent shape of the attachment portion 3*c* and the spacer portion 3*d*. Since the attachment portion 3*c* of the socket member 3 extends from the upper end toward the loose lower end of the socket member 3 and is tilted toward the flat base plate 3*a* of the socket member 3, a space defined between the flat base plate 3*a* and the attachment portion 3*c* decreases progressively in a direction from the fixed upper end toward the loose lower end of the socket member 3. With this arrangement, when the releasable catch is in the assembled state, the tendency for the socket member 3 to turn about the secured upper end toward the second flexible part 1 of the article is enhanced. Thus, the loose lower end is forced against the front surface of the second flexible part of the article.

As described above, by virtue of the releasable catch of the present invention, the flap 2 of the rucksack can be opened and closed easily and reliably by a simple operation. Although only one embodiment of the present invention has been disclosed and described, it is apparent that the releasable catch of the invention can be applied to articles other than the bags. In addition, various minor changes and modifications of the present invention are possible in the light of the above teaching. For example, the spacer portion 3*d* of the socket member 3 may be omitted and the upper end of the socket member 3 may be directly attached the bag body. In this instance, the operation and effects attained are the same as described above so long as the lower end of the socket member is loose and not secured to the bag body. It is therefore to be understood that within the scope of the appended claims the invention may be practiced otherwise than as specifically described.

What is claimed is:

1. A releasable catch for holding together first and second flexible parts of an article, comprising:

(a) a plug member including an attachment portion adapted to be attached to the first flexible part of the article, and a locking tongue connected to said attachment portion and resiliently deformable about a juncture between the locking tongue and said attachment portion when depressed by a force applied from a front side of said plug member; and (b) a socket member including a flat base plate, a gate-shaped locked portion disposed on a front surface of said flat base plate adjacent an upper end thereof for slidably receiving therein said locking tongue to lock the same in said socket member, and an attachment portion disposed at said upper end of said flat base plate and adapted to be attached to the second flexible part of the article, wherein said locking tongue is tilted toward a back side of said plug member at a predetermined angle relative to a plane of said attachment portion of said plug member; and wherein said socket member further includes a spacer portion disposed between said flat base plate and said attachment portion of said socket member to space apart said flat base plate and said attachment portion by a distance, said attachment portion of said socket member extending from said upper end toward a lower end opposite to said upper end at an angle relative to said flat base plate such that the distance between said flat base plate and said attachment portion of said socket member decreases progressively in a direction away from said spacer portion.

2. A releasable catch according to claim 1, wherein said predetermined angle of bend is in the range of 20 to 40 degrees.

* * * * *